US009084330B2

(12) United States Patent
Wolf et al.

(10) Patent No.: US 9,084,330 B2
(45) Date of Patent: Jul. 14, 2015

(54) SHORT CIRCUIT DETECTION FOR LIGHTING CIRCUITS

(71) Applicant: Dialog Semiconductor GmbH, Kirchheim/Teck-Nabern (DE)

(72) Inventors: Christian Wolf, Gauting (DE); Andrea Acquas, Munich (DE); Stanly Jacob, Munich (DE); Marcelo DePaula Campos, Jaguariuna (BR)

(73) Assignee: Dialog Semiconductor GmbH, Kirchheim/Teck-Nabern (DE)

( * ) Notice: Subject to any disclaimer, the term of this patent is extended or adjusted under 35 U.S.C. 154(b) by 0 days.

(21) Appl. No.: 13/943,382

(22) Filed: Jul. 16, 2013

(65) Prior Publication Data

US 2014/0152180 A1 Jun. 5, 2014

(30) Foreign Application Priority Data

Nov. 30, 2012 (EP) ..... 12195113

(51) Int. Cl.
*H05B 37/00* (2006.01)
*H05B 33/08* (2006.01)

(52) U.S. Cl.
CPC ..... *H05B 33/089* (2013.01); *H05B 33/0884* (2013.01)

(58) Field of Classification Search
USPC ..... 315/121, 122, 294; 349/61; 257/328
See application file for complete search history.

(56) References Cited

U.S. PATENT DOCUMENTS

| | | | | |
|---|---|---|---|---|
| 7,606,679 | B1 | 10/2009 | Voicu et al. | |
| 8,189,313 | B1 * | 5/2012 | Kraft | 361/93.1 |
| 8,335,062 | B2 * | 12/2012 | Haines et al. | 361/42 |
| 8,503,145 | B2 * | 8/2013 | Hulett | 361/93.1 |
| 2006/0231745 | A1 | 10/2006 | Bodano et al. | |
| 2009/0302776 | A1 | 12/2009 | Szczeszynski | |
| 2010/0109557 | A1 * | 5/2010 | Bouchard | 315/294 |
| 2010/0289982 | A1 * | 11/2010 | Akiyama et al. | 349/61 |
| 2011/0062872 | A1 * | 3/2011 | Jin et al. | 315/122 |
| 2011/0234105 | A1 | 9/2011 | Castiglia et al. | |
| 2012/0049740 | A1 * | 3/2012 | Kang et al. | 315/121 |

OTHER PUBLICATIONS

European Search Report 12195113.1-1807 Mailed: May 23, 2013, Dialog Semiconductor GmbH.

* cited by examiner

*Primary Examiner* — Thuy Vinh Tran
*Assistant Examiner* — Syed M Kaiser
(74) *Attorney, Agent, or Firm* — Saile Ackerman LLC; Stephen B. Ackerman

(57) ABSTRACT

This invention relates to control circuits for LED systems with a feedback loop to regulate a drive voltage. A controller for the system is proposed comprising a plurality of LED circuits and a controllable power source. The controller comprises a control unit configured to cause regulation of the drive voltage based on a determination of a plurality of feedback voltages and a fault condition detecting means. At least one of the LED circuits is determined as having a fault condition if the respective feedback voltage is below a fault threshold. In response to a detected fault condition, a test voltage is applied to a cathode of the fault circuit to confirm the presence of a fault condition.

13 Claims, 7 Drawing Sheets

SHORT CIRCUIT DETECTION FOR LIGHTING CIRCUITS

TECHNICAL FIELD

This application relates to control circuits for lighting systems. In particular, it relates to control circuits for LED lighting systems with a feedback loop to regulate a drive voltage for the lighting system.

BACKGROUND

Light-emitting diodes (LED) are semiconductor light sources traditionally used as indicator lamps in many devices. In addition, LEDs are increasingly also being used for lighting, where one particular use is for providing backlighting. For example, LED backlighting is increasingly being used for liquid crystal displays (LCDs), as LCDs do not produce their own illumination. Furthermore, LED backlight lighting systems are becoming increasingly common for the use in display backlighting and keypad backlighting in portable devices such as cell phones, smartphones, PDAs, digital cameras, personal navigation devices and other portable devices with keypads and/or LCD displays.

LED lighting systems are generally associated with a variety of advantages over traditional lighting sources such as incandescent lighting. For example, LEDs are efficient, associated with longer life, exhibit faster switching and produce less heat than traditional lighting sources. Due to the faster switching characteristics of LEDs, they are suitable for use in fast and highly responsive circuits by allowing for both quick response/start-up time and the capability to be operated at high frequency, further allowing for such enhancements as frequency modulation in order to reduce power consumption.

LED lighting systems typically comprise "strings" of stacked LEDs in which multiple LEDs are connected in series. Therefore the LED driver control circuit has to be able to provide a regulated high supply voltage. A common practice is to pull a well-defined current from the bottom of each LED string, via current sources or resistors and regulating the voltage across them. In such a way the power dissipation across the current sources can be minimized. In order to protect the system components from excessive voltage levels and avoid excessive high current to flow in the LED circuit, an overvoltage protection mechanism is generally provided to disable the delivery of power to the circuit in the event that the voltage rises above a certain threshold.

In lighting systems with a common voltage supply and various strings of LED similar to the one illustrated in FIG. 1, a short circuit between ground voltage and the cathode of one of the lowermost LED (feedback nodes 102-1 to feedback nodes 102-N in FIG. 1 below) causes a voltage drop at the affected LED string. In such a condition, the feedback mechanism employed to regulate the drive voltage provides no control over the current flowing to the LEDs of the affected LED strings. Such a short circuit condition generally causes the drive voltage to be further increased leading to an uncontrollable boost of the current flowing to the LEDs of the affected LED strings and to an increase of the heat generated by the system. If the short circuit remains for some time, the involved components can be damaged.

Thus, there is a need for a fault-tolerant controller that is capable of providing short circuit detection.

This application provides a controller for a lighting system comprising a plurality of light emitting diode "LED" circuits. A controllable power source provides a drive voltage to power the plurality of LED circuits. The controller comprises a control unit configured to cause regulation of the drive voltage based on a determination of a plurality of feedback voltages, one feedback voltage for each of the plurality of LED circuits.

The controller further comprises a fault condition detecting means configured to identify one or more fault conditions from the plurality of feedback voltages. A LED circuit is determined as a fault circuit having a fault condition if its respective feedback voltage is below a first fault-circuit condition threshold. The fault condition detecting means is further configured, in response to a detected fault condition, to apply a test voltage to a cathode of the fault circuit. If the feedback voltage of the fault circuit remains below a second fault-circuit condition threshold, the fault circuit is determined to have a short circuit condition. The fault condition detecting means may include a pull-up circuit that can apply a test voltage or test current between ground voltage and a cathode of the fault-circuit in an attempt to pull the node up that has been detected with a fault condition. However, if there is a short circuit, the feedback voltage cannot be pulled up, the detection of which indicates a short circuit condition. By way of example, the first fault-circuit condition threshold may be set to the same threshold value as the second fault-circuit condition threshold.

In accordance with a further aspect, the fault circuit may be determined to have an open circuit condition if the feedback voltage of the fault circuit exceeds the second fault-circuit condition threshold when the test voltage or test current is applied to the cathode of the fault circuit. Consequently, the controller described in this application may provide for both short circuit and open-string detection and can distinguish between these two conditions based on the same fault condition detecting means. For example, in the LED lighting systems with "strings" of stacked LEDs in which multiple LEDs are connected in series, if one of the many individual LEDs in an individual LED string fails, an open circuit condition for the entire associated LED string can occur. In such a condition the feedback mechanism employed to regulate the drive voltage generally causes the drive voltage to be further increased up to the point where the overvoltage protection circuitry would disable the entire lighting system. LED lighting systems can have many LED strings, for example five, six or even thirty or more. Consequently, if an open circuit condition occurs in any one of the LED strings, the entire lighting system becomes inoperable due to the overvoltage protection mechanism. While this solution does successfully protect the circuits from the excessive currents associated with an overvoltage condition, the entire circuit and all the LED strings become unusable if there is an open circuit condition in only one of the LEDs of one of the plurality of LED strings. The proposed fault-tolerant controller is configured to not only detect a short circuit condition but also an open-string condition and to distinguish between these two conditions which allows to continue operating the system in the event of an open circuit condition in one or more of the plurality of LED strings, e.g. by excluding the string having the open circuit condition from the voltage feedback control mechanism.

In accordance with a further aspect, the fault condition detecting means may comprise a plurality of pull-up circuits, one pull-up circuit provided between ground voltage and a cathode for each LED circuit. Each pull-up circuit may comprise a voltage source and a switch. The fault condition detecting means may be configured to close the switch associated with the fault circuit upon detecting a fault condition to apply the test voltage or test current between ground voltage and the cathode of the fault circuit. By way of example, the test voltage is small compared to the boost voltage to operate the LED strings in order not to damage the LEDs in case of a short circuit condition.

The controller may further comprise a plurality of comparators and a plurality of logic gates, one comparator and one logic gate for each LED circuit, to detect a fault-circuit condition indication for each of the LED circuits. A comparator may be configured to conduct a comparison between the respective feedback voltage of one of the plurality of LED circuits and the first fault-circuit condition threshold, and to input the comparison result into the respective logic gate. The use of a plurality of comparators allows the controller to determine a respective fault condition indication for each LED circuit. The feedback voltages are then compared to the first and/or second fault-circuit condition threshold.

In accordance with a further aspect, the fault condition detecting means may be configured to determine whether a short circuit condition exists in the plurality of light emitting diode "LED" circuits during a pre-start test before the normal operation of the LED lighting system is started. During the pre-start test no drive voltage is supplied to the plurality of light emitting diode "LED" circuits. A short circuit condition often results from error in the manufacturing process. Thus, testing the LED circuits for a short circuit condition before using the LED circuit under normal operational load and with no drive voltage being supplied to the plurality of light emitting diodes allows detecting such a condition before the LEDs are damaged by the short circuit condition. In order to protect the LEDs from uncontrolled current flows under a short circuit condition, the controller is preferably configured to disable the drive voltage and the boost voltage to power the plurality of LED circuits after a short circuit condition has been detected during the pre-start test. Preferably a LED circuit having a detected short circuit condition is disabled, i.e. switched off from the drive voltage provided by the power source, e.g. by blowing respective fuses in the LED circuit or setting/opening respective switches in the LED circuit. This allows usage of the lighting system under reduced conditions (e.g. reduced light emission) while neither components of the LED circuit nor the power supply is damaged during operation of the lighting system.

In accordance with a further aspect, in response to a pre-start test with no short circuit condition being detected, the controller may be configured to wait for a predetermined time interval before regularly determining during operation under a normal load condition whether a fault condition exists in one of the plurality of light emitting diode "LED" circuits. This has the advantage that a false detection during unstable and transient start-up conditions is avoided. The regular determination of a fault condition during normal load operation can be performed in regular time intervals, or after a predetermined time under normal load operation has passed, so as to periodically test the LEDs for being operative.

In accordance with a further aspect, the controller may further comprises a minimum voltage selector configured to exclude the one or more respective feedback voltages for each respective LED string associated with an open circuit condition, thereby excluding the respective feedback signal from the determination of the minimum feedback voltage. This improves the regulation of the drive voltage and allows the lighting system to continue to operate in the event of an open circuit condition in one or more of the plurality of LED strings.

In order to improve the detection accuracy of a fault condition, the fault condition detecting means may be configured to sample the feedback voltage of the fault circuit a predetermined number of times (e.g. at least two times) before determining the short circuit condition of the fault circuit.

In addition, a lighting system comprising a plurality of light emitting diode "LED" circuits, a controllable power source and the controller as described above is provided to provide LED short circuit detection and/or LED open circuit detection.

In addition, a method of detecting a fault condition within a plurality of light emitting diode "LED" circuits of a lighting system is provided. The method comprising the steps: determining feedback voltages for each of the LED circuits of the plurality of LED circuits; causing regulation of a drive voltage to power said plurality of LED circuits based on the determination of a plurality of feedback voltages; determining a fault circuit having a fault condition among the plurality of LED circuits for which the respective feedback voltage of the respective LED circuit is below a first fault condition threshold; in response to the detected fault condition, applying a test voltage to a cathode of the determined fault circuit having the fault condition, and if the feedback voltage of the fault circuit remains below a second fault-circuit condition threshold, determining the fault circuit as having a short circuit condition. Preferably a LED circuit having a short circuit condition is disabled, i.e. switched off from the drive voltage provided by the power supply so that neither components of the LED circuit nor the power supply are damaged during operation of the lighting system. By disabling a particular LED circuit having a short circuit condition it is possible to operate the remaining LED circuits of the lighting system without the need to disable or discard the entire lighting system.

The method may further comprise the step of determining the fault circuit as having an open circuit condition if the feedback voltage of the fault circuit exceeds the second fault-circuit condition threshold after the test voltage has been applied to the cathode of the fault circuit. In this case, it can be concluded that the fault LED circuit has an open circuit and should be excluded from providing a feedback voltage for the power regulation loop. Normally, a LED circuit with an open circuit will not draw power and does not otherwise disturb operation of the other LED circuits which can therefore still be used.

In accordance with a further aspect, the method of detecting a fault condition is conducted as a pre-start test of the lighting system before the normal operation of the LED lighting system is started. During the pre-start test no drive voltage is supplied to the plurality of light emitting diode "LED" circuits. The lighting system may be disabled in response to a detected short circuit condition during the pre-start test, or the only LED circuit having the short circuit is disabled while the other LED circuits are continued to operate.

The method may further comprise the steps of: enabling the lighting system after no short condition has been detected during the pre-start test, waiting for a predetermined time period before carrying out the steps for detecting a short circuit condition and a open circuit condition in predetermined time intervals; and in response to a detected open circuit condition, excluding the respective feedback voltage associated with the open circuit condition from said determination of a plurality of feedback voltages.

It will be appreciated that the method steps and apparatus features may be interchanged in many ways. In particular, the details of the disclosed apparatus can be implemented as a method, and the disclosed method steps implemented as apparatus features, as the skilled person will appreciate.

The invention is explained below in an exemplary manner with reference to the accompanying drawings.

DETAILED DESCRIPTION

Figure 1:
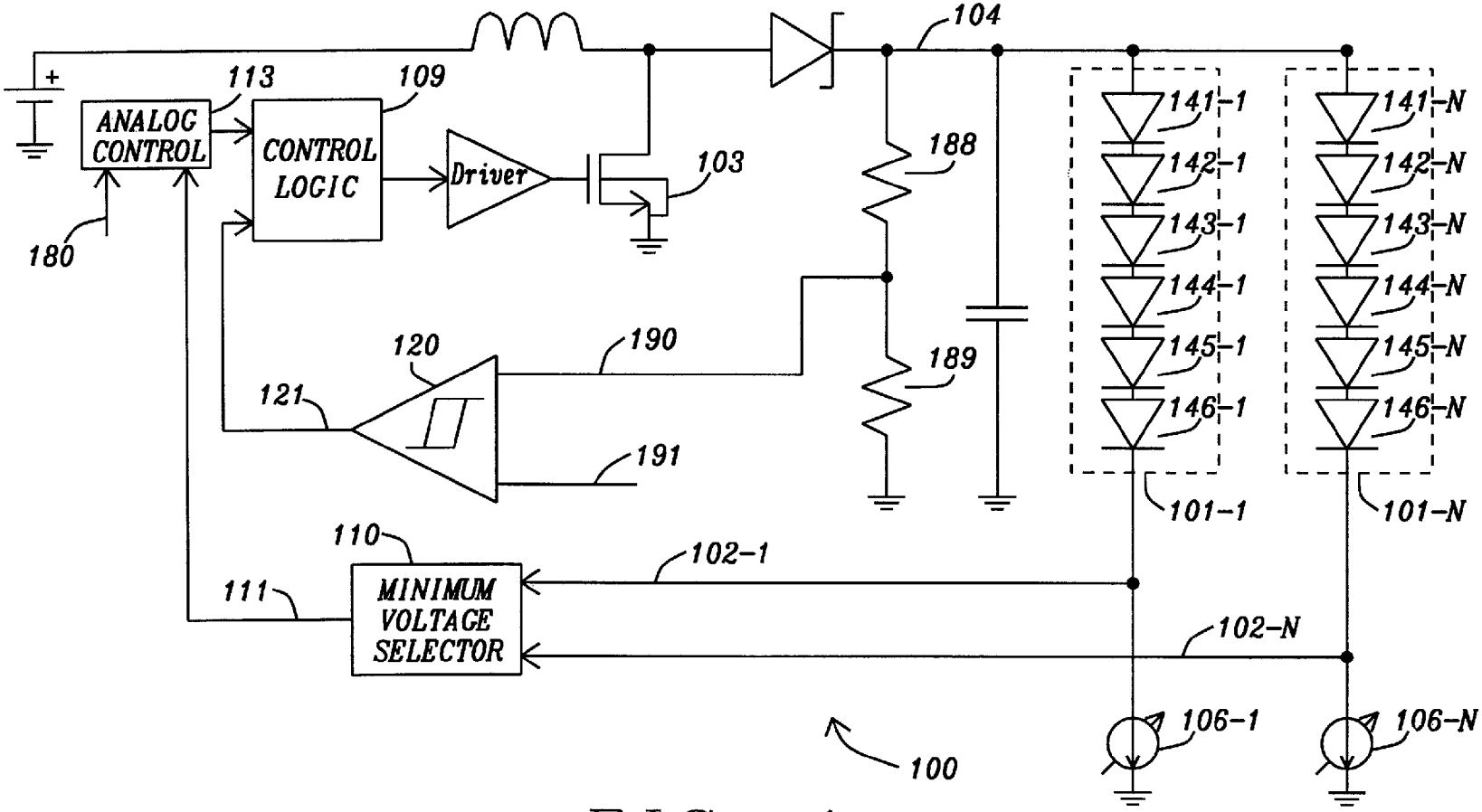
FIG. 1 shows a circuit diagram of an LED lighting system with 'N' LED strings, feedback mechanism and overvoltage protection mechanism.

FIG. 1 shows a circuit diagram of an LED lighting system with 'N' LED strings, feedback mechanism and overvoltage protection mechanism. Lighting systems based on LEDs typically employ a step-up converter in a closed-loop operation to provide the LEDs with stable and well controlled output voltages and currents for a broad range of voltage sources.

Some systems are capable of supplying two or more strings of stacked LEDs as shown in FIG. 1, with the lighting system 100 comprising a boost converter that supplies 'N' strings of six LEDs, where the lowermost LED in each string has the cathode connected to a programmable current source 106-1, 106-N.

The programmable current sources 106-1, 106-N define the current through each LED string 101-1, 101-N. After the voltage drops across the LED strings 101-1, 101-N, the signals at the cathode sides of the lowest LEDs 146-1, 146-N are fed as feedback signals 102-1, 102-N connected to a minimum voltage selector circuit 110 that then feeds the lowest voltage 111 among these 'N' signals to an analog control circuit 113. This regulation scheme provides high efficiency since power dissipation over the programmable current sources 106-1, 106-N is minimized. Furthermore, the analog control 113 operates with the control logic 109 to drive an NMOS transistor 103 with a duty-cycle that generates an output voltage as a drive voltage 104 for the LED strings 101-1, 101-N high enough to guarantee that the voltage drop across every current source 106-1, 106-N is higher than a minimum value, based on a reference voltage 180.

Figure 2:
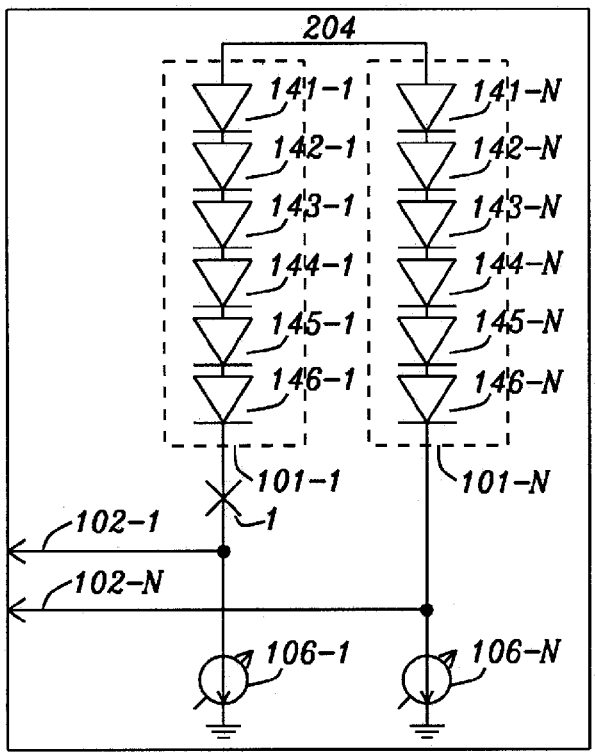
FIG. 2 illustrates an open-string situation in one of the LED strings.

The circuit diagram for an LED lighting system with 'N' LED strings 101-1, 101-N shown in FIG. 1 is provided with an overvoltage protection mechanism. This overvoltage protection is based on a feedback signal 190 based on the drive voltage 104. In the embodiment in FIG. 1, a pair of resistors 188, 189 is used, generally known as a voltage divider, where the drive voltage feedback 190 is measured between the two resistors 188, 189 of the voltage divider. For such a system, if one LED string 101-1, 101-N is open (e.g. the LED string 101-1 as shown in FIG. 2) then its respective feedback node 102-1, 102-N is pulled to ground by the respective current source 106-1, 106-N resulting in the respective feedback 102-1, 102-N being selected as the minimum voltage 111. Consequently, the analogue control circuit 113 reacts to increase the drive voltage 104 in order to attempt to raise the minimum feedback voltage 111 to match the reference voltage 180.

As each string of LEDs 101-1, 101-N is made up of multiple LEDs 141-1, 142-1, 143-1, 144-1, 145-1, 146-1 to 141-N, 142-N, 143-N, 144-N, 145-N, 146-N connected in series, if one LED in the string fails, then this minor failure results in an open circuit condition 1 for the entire LED string 101-1, 101-N. This situation is illustrated in FIG. 2. However, as no current flows in an LED string with an open circuit condition and there is little or no voltage drop across the LEDs of an LED string with an open circuit condition, the feedback loop will incorrectly indicate that the drive voltage should be further increased. However, further increases in the drive voltage do not increase the voltage drop, as no current flows in the LED string with an open circuit LED. Thus, the feedback loop further increases the drive voltage.

In particular, despite the increase in the drive voltage 104, the minimum voltage 111 does not increase because of the open circuit condition, which keeps the selected minimum voltage 111 near ground. Thus, the drive voltage 104 increases until it is higher than the overvoltage threshold 191, which then causes the entire lighting system 100 to be disabled due to the overvoltage protection. Consequently, if an open circuit condition 1 occurs in any one of the LED strings 101-1, 101-N, the entire lighting system 100 becomes inoperable due to the overvoltage protection mechanism.

While this solution does successfully protect the circuits from the excessive currents associated with an overvoltage condition, the entire circuit and all the LED strings 101-1, 101-N become unusable if there is an open circuit condition in one (or more) of the LEDs of one (or more) of the LED strings 101-1, 101-N. Such lighting systems can have many LED strings, for example five, six or even thirty or more.

Figure 3:
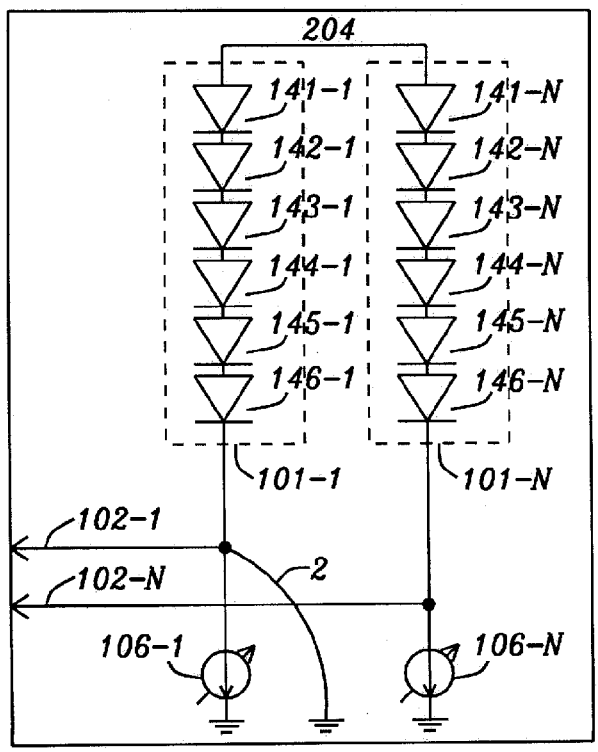
FIG. 3 illustrates a short circuit to the ground situation in one of the LED strings.

FIG. 3 depicts the occurrence of short circuit to the ground. In lighting systems with one voltage supply and various strings of LEDs similar to the one illustrated in FIG. 1, a short circuit between ground voltage and the cathode of one of the lowermost LED (feedback nodes 102-1 to 102-N in FIG. 1 below) causes a voltage drop at the affected LED string. In such a condition, the feedback mechanism employed to regulate the drive voltage provides no control over the current flowing to the LEDs of the affected LED strings. Thus, in both cases as shown in FIG. 2 and FIG. 3, the voltage at the node of the feedback voltage of the LED string 102-1 to 102-N with the short circuit is virtually zero. A short circuit condition generally causes the drive voltage to be further increased, leading to an uncontrollable boost of the current flowing through the LEDs of the affected LED strings and to an increase of the heat generated by the system. If the short circuit remains for some time, the involved components can be damaged. Thus, in contrast to the open circuit condition, the LEDs might be damaged by a short circuit condition.

Thus, there is a need for a fault-tolerant controller that is capable of being able to detect both a short circuit to the ground and an open-string situation. There is a further need distinguish between these two fault conditions as different response actions are required.

Figure 4:
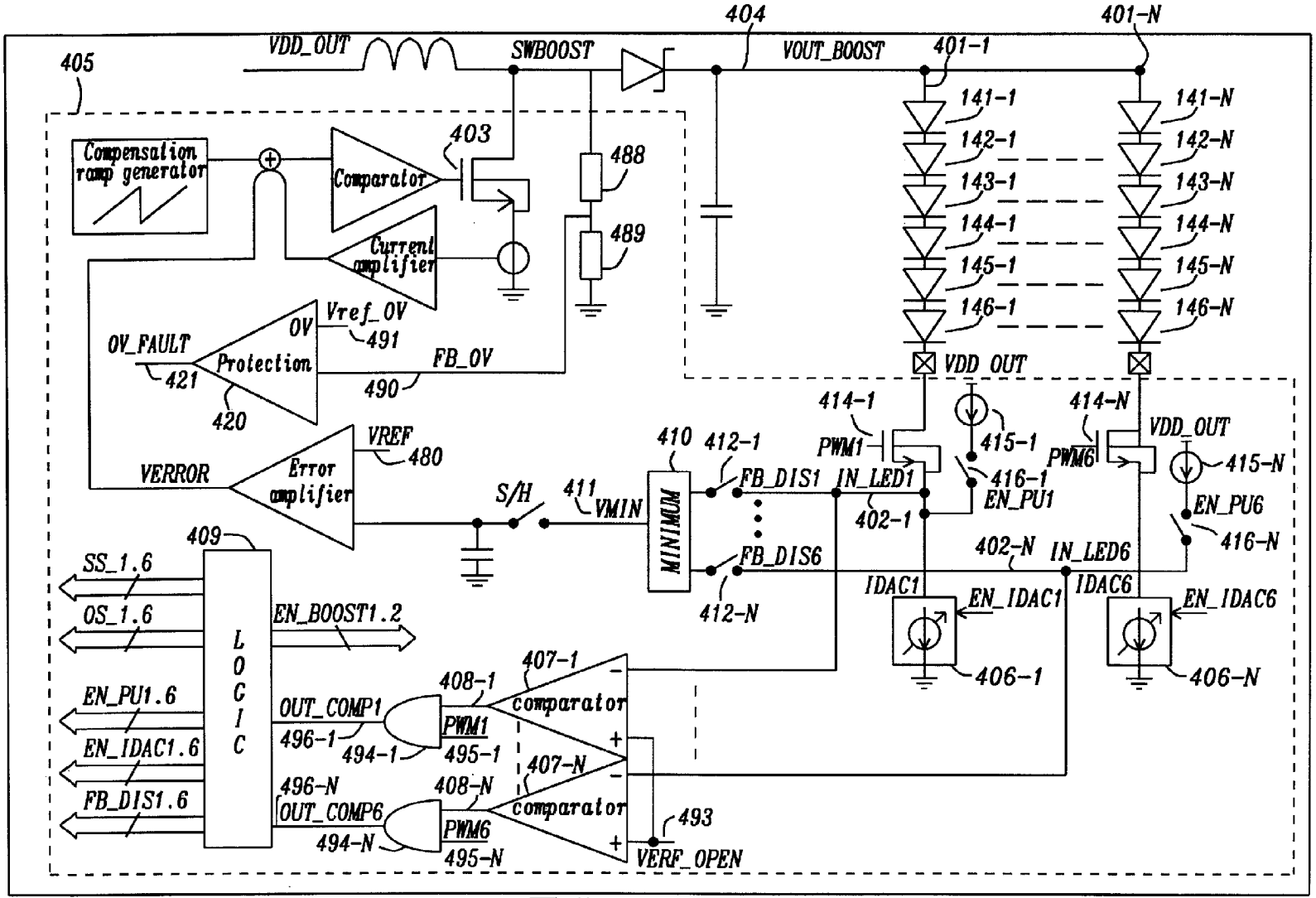
FIG. 4 shows a circuit diagram of an LED lighting system with short circuit and open-string detection according to an embodiment.

A functional block diagram illustrating an example embodiment of the short circuit to the ground and the open-string detection is shown in FIG. 4. The LED lighting system 400 includes multiple LED strings 401-1, 401-N connected in parallel to a controllable power source 403 that provides a drive voltage 404. The number 'N' corresponds to the number of LED strings and may vary. For example, there may be two, five, six, thirty, one hundred or more LED strings. Each of the LED strings 401-1, 401-N consists of a plurality of LEDs. In this example embodiment, each LED string includes six LEDs in series. For example, LED string 401-1 consists of LEDs 441-1, 442-1, 443-1, 444-1, 445-1, 446-1 and each further LED string 201-N also consists of six LEDs 441-N, 442-N, 443-N, 444-N, 445-N, 446-N. The number of individual LEDs in each LED string can vary, for example, there may be only one LED per string or as many as a few hundred LEDs per LED string.

The controller 405 of this embodiment is shown in FIG. 4 as the area within the dashed line, as the controller 405 comprises multiple sub-functions, such as the control logic 409 and minimum voltage selector 410, which are described below. These functions could be provided by separate discrete components or combined into an integrated circuit. Thus, the schematic should not be interpreted as requiring or limiting any particular components or parts; rather, the controller can have a variety of concrete realizations, as there are many possibilities through which the logic can be realized, i.e. discrete circuit components, integrated circuits, digital logic inside a programmable controller, computer-programmable circuits or a computer programmed to carry out the depicted functions and methods.

The cathode of the last LED 446-1, 446-N of each of the LED strings 401-1, 401-N furthest from the controllable power source 403 (i.e. the lowest LED in each string in FIG. 4) is connected to a respective programmable current source 406-1, 406-N to provide current for the respective LED string 401-1, 401-N. In order for the lighting system to operate with high efficiency, it is desirable to reduce the power dissipation in the programmable current sources 406-1, 406-N. This goal can be achieved by keeping the voltage across each programmable current source 406-1, 406-N as low as possible, while still ensuring that there is a sufficient voltage drop across the LEDs 441-1, 442-1, 443-1, 444-1, 445-1, 446-1, 441-N, 442-N, 443-N, 444-N, 445-N, 446-N of each respective string 401-1, 401-N. To this end, use is made of the feedback voltages 402-1, 402-N at the junctions between the cathodes of the last LED 446-1, 446-N of each of the LED strings 401-1, 401-N furthest from the controllable power source 403 and the respective programmable current sources 406-1, 406-N. These feedback voltages 402-1, 402-N are then used as inputs to the minimum feedback selector, in particular to determine the feedback minimum voltage 411.

The controller 405 in the example in FIG. 4 also includes an optional overvoltage fault protection mechanism 420, which serves to disable delivery of power to the LED strings 401-1 to 401-N in the event that the drive voltage 404 is too high, as such a high voltage is associated with high currents in the LED strings, potentially causing damage to the lighting system 400. This overvoltage protection is based on a drive voltage sample 490 based on the drive voltage 404. In the embodiment in FIG. 4, a pair of resistors 488, 489 is used as a voltage divider, where the drive voltage sample 490 is measured between the two resistors 488, 489. However, other structures could be used to sample a portion of the drive voltage 404, derive a feedback value relative to the drive voltage 404 or the drive voltage 404 could also be used directly. If the drive voltage sample signal 490 exceeds the overvoltage reference, overvoltage threshold 491, this condition indicates an overvoltage condition 421, and the controller proceeds to disable the lighting system by causing a reduction or interruption of power to the lighting system. Thus, the overvoltage protection acts to protect the lighting system from damage from a high voltage and the associated high current.

Next, the fault detection means will be described that detects a fault condition indication for each LED string 401-1 to 401-N and uses this information to conduct a follow-up test to determine whether the fault condition is due to an open circuit condition or due to a short circuit to the ground condition.

Figure 5:
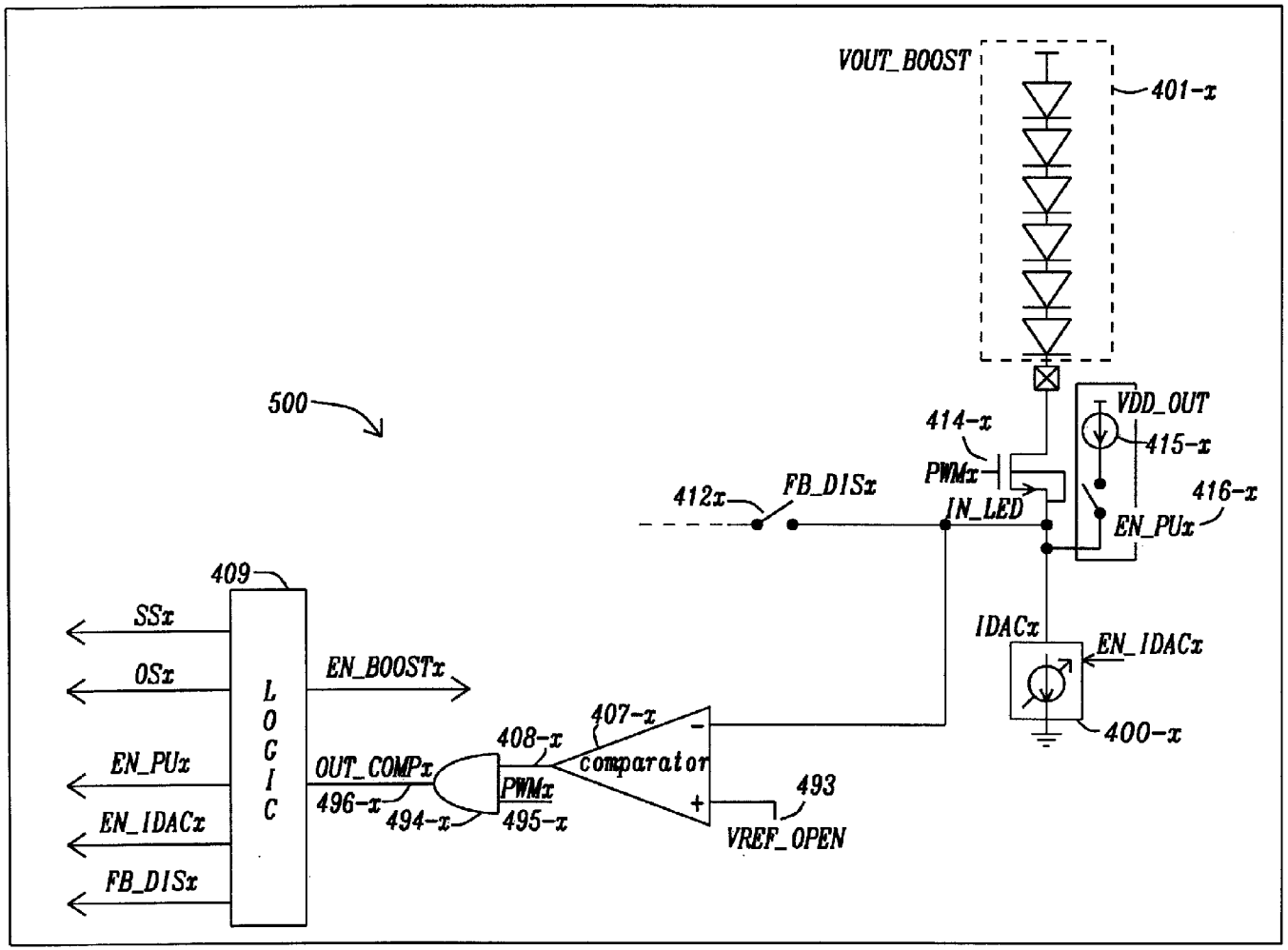
FIG. 5 illustrates the fault detection means according to an embodiment.

The fault detection means comprises N sense comparators 407-1 to 407-N to detect a fault condition indication for each LED string 401-1 to 401-N. In addition to the comparators 407-1 to 407-N, a pull-up circuit is provided to detect and differentiate between short circuit and open string detection. The pull-up circuit includes a plurality of voltage sources 415-1 to 415-N and switches 416-1 to 416-N, one voltage sources and one switch for each LED string 401-1, 401-N. A cut-out view of the fault detection means 500 is shown in FIG. 5, showing only one (denoted with "–x") of the N pull-up circuits associated with each string 401-1 to 401-N. The voltage applied by the pull-up circuit is lower than the "normal" boost voltage applied to the LED during normal operating conditions so that the LEDs are not damaged by the applied voltage of the pull-up circuit when testing for fault conditions.

Referring again to FIG. 4 the voltage at each LED string feedback node 402-1 to 402-N is compared to a fault condition reference voltage threshold 493, which is generally lower than the control-loop voltage reference 480. During normal operation the feedback loop regulates the drive voltage 404 to ensure that feedback nodes 402-1 to 402-N are at or above the voltage reference 480, and the comparators 407-1 to 407-N will provide in this case a logical 0 at their outputs 408-1 to 408-N, as the feedback voltage 402-1 to 402-N of each LED string 401-1 to 401-N is above the fault condition reference voltage threshold 493. The outputs 408-1 to 408-N serve as inputs to the logic gates 494-1 to 494-N. The output of the logic gates is denoted with 496-1 to 496-N (or Out_COMPx, x=1 . . . N, N being 6 in the current embodiment).

Under normal conditions, the enabler EN_PUx of the control logic 409 is driven to disconnect the voltage source 415-*x* (also labelled as VDD_OUT) from the circuit. Under this condition, a fault event is detected by the control logic 409 if one of the outputs 496-1, 496-N of the logic gates (also labelled as OUT_COMPx in FIG. 5) goes high when the corresponding second input 495-1, 495-N (also denoted as PWMx in FIG. 5) of the logic gate 494-1 to 494-N is set to high. The reason is that in case of a broken string connection causing an open LED string or in case of a short to the ground condition, the corresponding feedback voltage 402-1 to 402-N will be pulled to ground causing the corresponding comparator 407-1 to 407-N to toggle its output, i.e., the outputs 408-1 to 408-N, to high. The outputs 496-1 to 496-N of the logic gates thus serve as fault condition indicators.

After a fault event is detected at one (496-*x*) of the fault condition indicators 496-1 to 496-N, the control logic block 409 will disconnect the feedback node of the corresponding fault string and then drive EN_PUx to connect the voltage source 415-*x* (VDD_OUT) to the negative input of the comparator 407-*x*, in an attempt to pull this node up while disconnecting the corresponding IDACx. Preferably, the respective PWMx switch is on when the test voltage/test current is applied in the attempt to pull the node up. However if the there is a short circuit between the LED circuit 401-*x* and ground, the negative input of the comparator 407-*x* will continue to be pulled down so that the output of the corresponding comparator 407-1 to 407-N remains high. Thus, the output 496-*x* of the logic gate 494-*x* remains high at logic 1 (when PWMx is 1).

Therefore, if the output 496-*x* is sampled as high by the Logic block 494-*x* when 495-*x* (PWMx) is high, it indicates a short circuit condition. On the other hand if there is an open string at the LED circuit 401-*x*, the negative input of the comparator 407-*x* will be pulled up to VDD_OUT making the output 496-*x* to logic 0. So if the output 496-*x* is sampled as low (when PWMx is high) by the Logic block 496-*x*, it indicates an open string in the LED circuit 401-*x*. The EN_IDACx as illustrated in FIG. 5 is switched off before performing the open/short test to avoid any conflict between pull-up 415-*x* and pull-down 400-*x* of FIG. 5. It is not necessary to turn on the IDACx after the open/short test.

In order to adjust the drive voltage 404 to provide the desired lighting in a highly efficient manner, a minimum feedback voltage selection 410 is used to select the minimum feedback voltage 411 from the LED strings 401-1 to 401-N. However, as any LED string 401-1, 401-N with an open circuit or short circuit will have a very low feedback voltage 402-1 to 402-N at or near ground, the fault condition detecting means of the controller 405 described in this embodiment determines an open circuit or short circuit condition associated with each of the open LED strings 401-1 to 401-N (see description above). Consequently, the controller 405 uses the minimum voltage selector 410 to ignore the feedback voltages 402-1 to 402-N of any LED strings 401-1 to 401-N associated with an open circuit or short circuit condition by excluding them from the determination of the minimum feedback voltage. Thus, the minimum feedback voltage 411 is determined for the LEDs 401-1 to 401-N not associated with an open circuit or short circuit condition in order to provide more efficient regulation of the drive voltage 404 and to avoid disabling of the entire lighting system by the overvoltage protection mechanism due to the fault condition.

In FIG. 4, switches 412-1 to 412-N are shown as being controlled by the control logic 409 (cf. outputs labelled as FB_DIS1 to FB_DIS6) in order to remove the respective feedback signals 402-1 to 402-N from the minimum feedback voltage 411 determination of the minimum voltage selector 410. However, actual switches do not need to be used. For example, the minimum voltage selector 410 could have additional inputs indicating which of the feedback voltage signals 402-1 to 402-N should be ignored in the determination of the minimum voltage signal 411. Other structures or configurations could be used; for example, a controllable multiplexer could be used with a single comparator with the control mechanism configured to cause the multiplexer to cycle through the non-excluded feedback voltage signals 402-1 to 402-N.

Thus, the comparator would be provided with one of the feedback voltage signals 402-1 to 402-N at a time, one after another, in order to determine the minimum voltage signal 411, where the feedback voltage signals 402-1 to 402-N corresponding to LED strings 401-1 to 401-N associated with open circuit conditions are excluded. Thus, the excluded feedback voltage signals 402-1 to 402-N associated with open circuit conditions need not be output by the multiplexer, as the feedback voltage signals 402-1 to 402-N not associated with open circuit conditions are provided as inputs to the comparator for the determination of the minimum voltage signal 411.

The control logic 409 outputs enabling signals to control the circuit components as described above. For instance, the output signals labelled as FB_DIS1 to FB_DIS6 control the switches 412-1 to 412-N (with N having a value of 6 in the current embodiment). The output signals EN_IDAC1 to EN_IDAC6 control the programmable current source 406-1 to 406-N. The output signals EN_PU1 to EN_PU16 open and close the switches 416-1 to 416-N of the pull-up circuits. The output signals SS1 . . . 6 are switched to high if a short-circuit is detected in the corresponding circuit and the output signals OS1 . . . 6 are switched to high if an open-circuit condition is detected in the corresponding circuit (see also description having regard to FIG. 6). The EN_BOOST 1 . . . 2 signals enable two boost signals to supply two banks of LED strings.

In the schematic diagram in FIG. 4 of this example embodiment, a separate minimum voltage selector 410 is shown. However, this determination could be made in many other ways, for example using digital logic inside a programmable controller.

Figure 6:
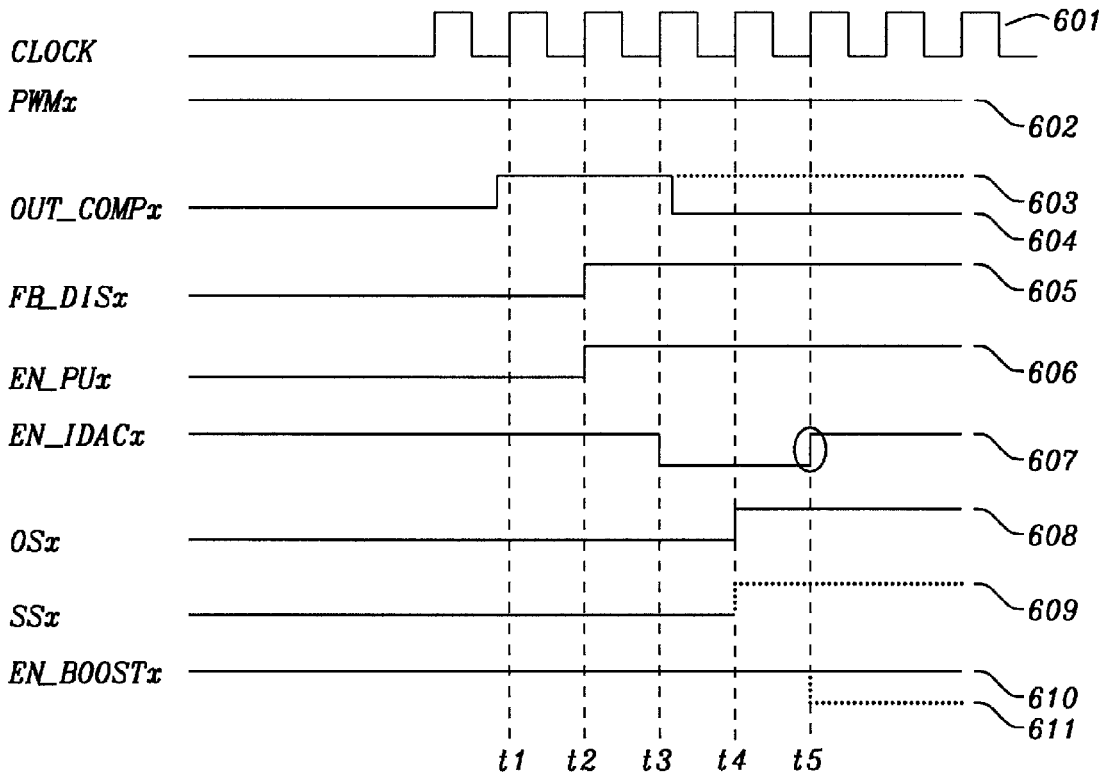
FIG. 6 shows a timing chart to illustrate the signal behavior during short circuit and open-string detection according to an embodiment.

FIG. 6 shows the signal behaviour of an open string condition (solid line) and a short circuit condition (dotted line) of the cut-out circuit portion shown in FIG. 5. The upper most signal line 601 represents the clock rate for reference of timing inside the control logic block 409. The second input 495-*x* of the logic gate 494-*x* is set to high as indicated by the signal line 602. After a certain moment t1, the fault condition indicator 496-*x* (Out_COMPx) corresponding to the signal line 603 switches from low to high indicating a fault condition. At time t2, the control logic 409 outputs a signal to set the output FB_DISx to high to open the switch 412-*x* as indicated by the signal line 605. In addition, the control logic 409 outputs an enabling signal EN_PUX to close the switch 416-*x* to apply a voltage between ground voltage and a cathode of the fault circuit 401-*x*, as indicated by the signal line 606.

If the signal line 604 remains high after the voltage between ground voltage and a cathode of the fault circuit 401-*x* has been applied (dotted line 603), it indicates a short circuit condition so that the short circuit signal 609 (SSx) switches to high. If, however, the fault condition indicator switches back to low, after the voltage between ground voltage and a cathode of the fault circuit 401-*x* has been applied, it indicates an open circuit condition (solid line 604). In this case, the open circuit (OSx) signal 609 instead of the SSx signal switches to high at time t4.

In case of a short circuit condition, the boost voltage signal EN_BOOSTx has to be switched off to protect the LED string, as indicated by the dotted line 611. No switch off is required in an open string situation (signal line 610) since the corresponding string can be excluded from the feedback voltage control mechanism, as described above.

The signal line 607 describes the output of the control signal EN_IDACx of the respective programmable current source 406-*x*.

The method steps performed by the controller 405 shown in FIG. 4 will now be described in detail in relation to FIGS. 7 to 9. The method in FIG. 7 is applicable for providing short circuit detection for start-up of the lighting system whereas FIG. 8 illustrates the method for providing short circuit detection and open string detection for normal steady-state operation of the lighting system.

Figure 7:
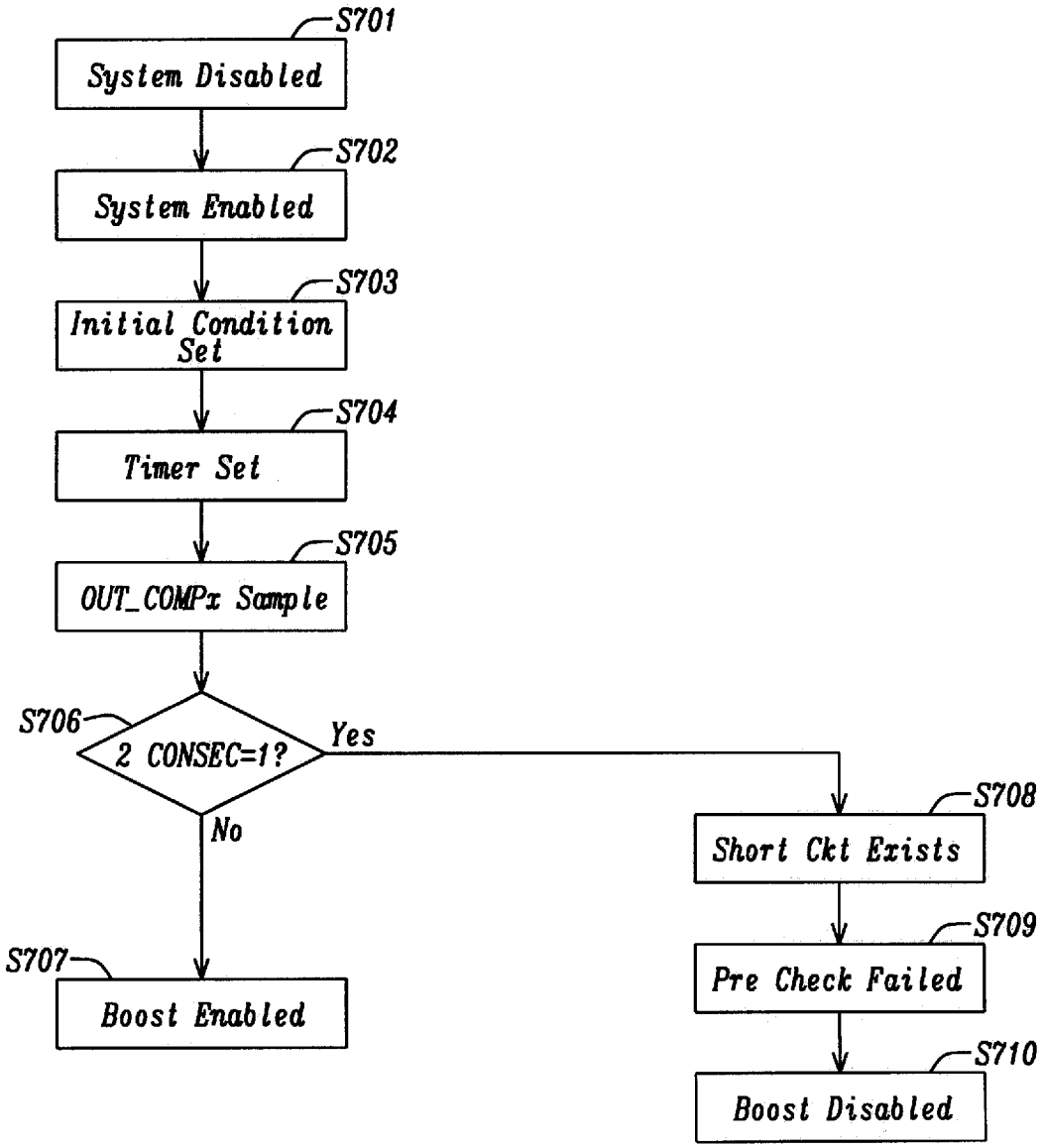
FIG. 7 shows a flow diagram of steps involved in a pre-start test for a short circuit detection according to an embodiment.
Figure 8:
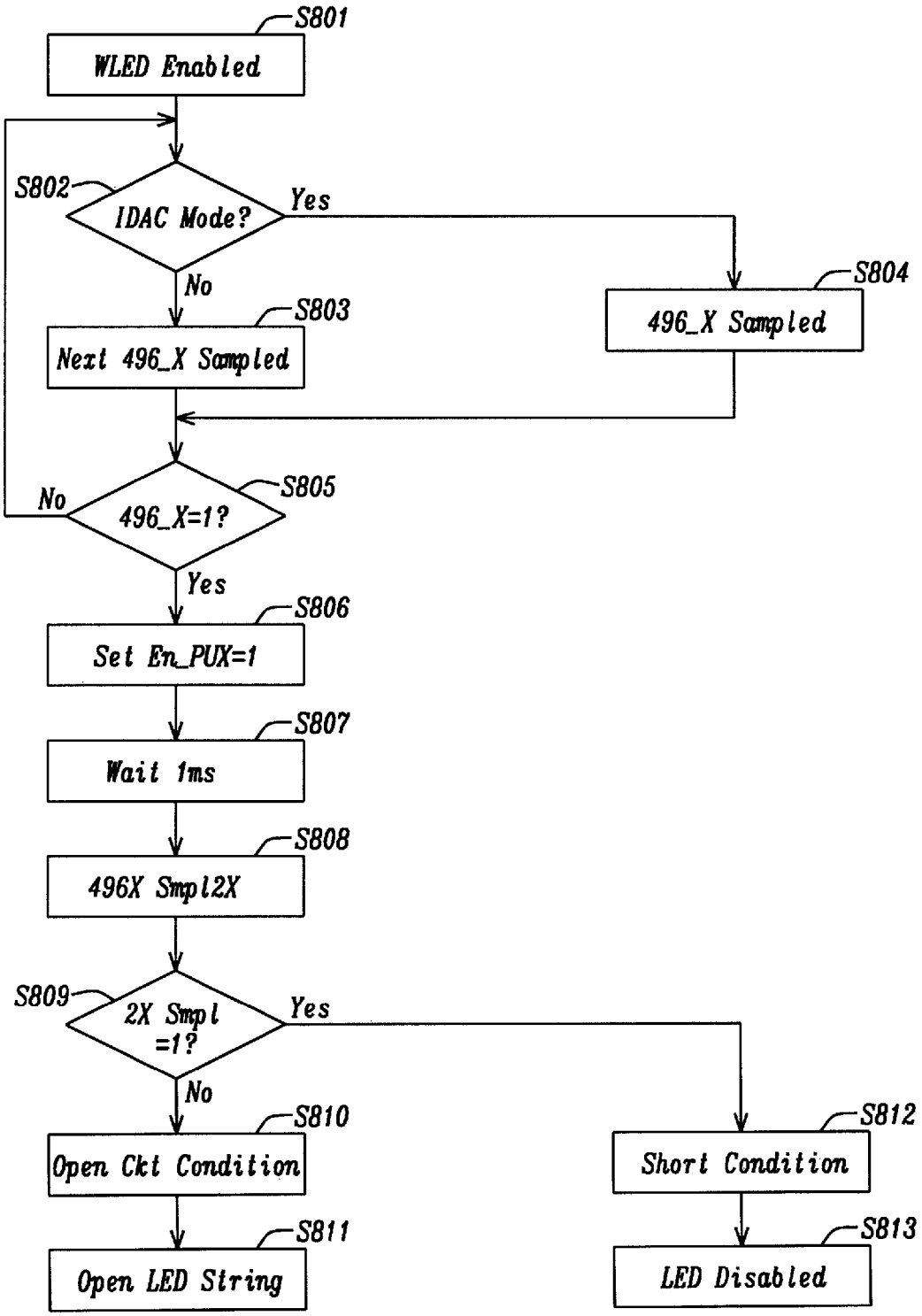
FIG. 8 shows a flow diagram of steps involved for short circuit and open-string detection during normal operation of a LED system according to an embodiment.

FIG. 7 shows a flow diagram of steps involved in a pre-start test for short circuit detection according to an embodiment. The majority of short circuits result from manufacturing defects. Thus, in order to avoid damaging the LEDs of lighting systems, a pre-start check is carried out to determine whether a short circuit condition exists before the LED lighting system is enabled.

In step S701, the LED lighting system is disabled. In step S702, the LED lighting system is enabled through a communication interface (I2C/DWI) used to program the device.

For carrying out the pre-start test of the LED circuit 401-*x*, in step S703, the reference voltage Vref_OV 491, the second input signal 495-*x* of the logic gate 494-*x*, and the output signal EN_PUx for closing the switch 416-*x* will be asserted to 1. All other signals will be set to 0.

In step S704, a timer is set to wait for a specified interval, e.g. 1 ms, to allow sufficient time for transient conditions during the open circuit/short circuit test to settle. After 1 ms delay, the OUT_COMPx signal 496-*x* is sampled in step S705. In step S706, it is determined if two consecutive samples indicate a 1. If yes, the inference is that a short circuit exists (step S708) and that the pre-check test failed (step S709). As a result, the boost is disabled to protect the LEDs in step S710. If, however, it has been determined that two consecutive samples are not 1 in step S706, the pre-start test is determined to be successful and the boost can be enabled in step S707 to make the WLED system operational.

FIG. 8 illustrates the method for providing short circuit and open string detection for normal steady-state operation of the lighting system, i.e. under normal load conditions. After the pre-start test is successfully completed, the WLED system will enabled in step S801.

After the WLED system is enabled, the digital logic block 409 will not sample OUT_COMPx signals 496-*x* for an initial programmable time after enabling the corresponding boost in order to avoid false detection during start-up. After this initial delay, the digital logic block 409 will regularly perform the operational check by carrying out the steps S802 to S813.

In step S802, it is determined whether the circuit is currently in digital-analog converter mode (IDAC mode). If yes, the output 496-*x* of the logic gate is sampled continuously in step S804, e.g. one sample every 2 μs. If the circuit is currently not in IDAC mode, the output 496-*x* of the logic gate is sampled when the second input 495-*x* of the logic gate 494-*x* is set to high, i.e., continuously during a pulse width modulation (PWM) cycle.

In step S805, it is determined whether output 496-*x* of the logic gate 494-*x* is 1. If no, no fault condition exists and the method returns to step S802. If yes, the method proceeds to step S806, wherein the pull-up circuit is activated by closing the switch 416-*x* by setting En-PUx as shown in FIG. 5 to 1 by the control logic block 409. A timer is set to wait 1 ms in step S807, after which the output 496-*x* of the logic gate 494-*x* is sampled two times in step S808.

If it is determined in step S810 that both samples are 1 (high), a short condition is determined in step S812 since the pull-up circuit could not pull the respective node up as the negative input of the comparator 407-*x* will continue to be pulled down so that the output of the corresponding comparator 407-1, 407-N remains high. Thus, the output 496-*x* of the logic gate 494-*x* remains high at logic 1 (when PWMx is 1). In response to the determined short circuit condition, in step S813, the LED lighting system is disabled. By contrast, if it is determined in step S810 that both samples are not at logic 1, this indicates an open circuit condition which is determined in step S810. In response, an open string flag for the respective LED string 401-*x* is set in the register and the feedback voltage 402-*x* of the string 401-*x* is excluded from the voltage feedback control mechanism, as described above with respect to FIG. 4.

While embodiments have been described for lighting systems that have an overvoltage protection mechanism (e.g. FIGS. 1 and 4), the teachings of the present application are equally applicable to lighting systems that do not have an overvoltage protection mechanism. In particular, the open-string detection and short circuit detection mechanism can be implemented without an overvoltage protection mechanism. Other types of open-string and short circuit detection could also be used according to the teachings of this application.

As mentioned above, the individual circuit components should not be interpreted as prescribing a fixed design. For example, the overvoltage fault detection 420, and the fault detection indicator signals 408-1 to 408-N, 496-1 to 496-N may be determined in the controller 405 or in the control logic 409.

Alternately, instead of the switches 412-1 to 412-N and the feedback voltages 402-1 to 402-N being provided as direct inputs to the minimum voltage selector 410, a MUX could be used to cycle through the non-excluded LED circuits and provide the feedback voltages 402-1 to 402-N of each LED string 401-1 to 401-N. Thus, the control logic 209 would provide the MUX with control signals indicating which of the feedback voltages 402-1 to 402-N should be output to the minimum voltage selector 410, and the MUX would cycle through the feedback voltages 402-1 to 402-N of LED circuits 401-1 to 401-N not associated with open circuit conditions. Similarly, instead of multiple comparators 407-1 to 407-N for each LED circuit 401-1 to 401-N, a single comparator and a MUX could be used to cycle through the feedback voltages 402-1 to 402-N and provide the fault condition indication 496-1 to 496-N for each of the LED circuits 401-1 to 401-N.

The techniques described in this patent application for a LED lighting system controller providing overvoltage circuit protection while maintaining operation of other LED strings in the event of an open circuit condition in one LED string could be applied by a person skilled in the art to other types of LEDs or even other types of diodes. Furthermore, LED lighting system controllers based on the teachings of this application should be appropriate for usage in a wide range of devices, such as cells phones, smartphones, PDAs, digital cameras, personal navigation devices and other portable devices with keypads and/or LCD displays as well as other devices requiring LED backlighting. The specific embodiments described herein are only intended to be teaching examples, which a person skilled in the art would then adapt for a specific design purpose.

Although the techniques described herein have been illustrated with specific examples, in which the comparisons are performed based on voltages, these techniques should not be limited to these examples or embodiments as the techniques can be equally applied to a situation where the comparisons are based on currents or charges.

It should be noted that the description and drawings merely illustrate the principles of the proposed devices and methods. It will thus be appreciated that those skilled in the art will be able to devise various arrangements that, although not explicitly described or shown herein, embody the principles of the proposed devices and methods and are considered to be part of the disclosure of this document. Furthermore, all statements herein reciting principles, aspects, and embodiments of the proposed methods and devices, as well as specific examples thereof, are intended to encompass equivalents thereof.

Furthermore, it should be noted that any circuit diagrams or block diagrams herein represent conceptual views of illustrative devices embodying the principles of the invention. Similarly, it will be appreciated that any control logic, state machines, state transition diagrams, and the like represent various processes which may be substantially represented in computer readable medium and so executed by a computer or processor, whether or not such computer or processor is explicitly shown.

Finally, all examples recited herein are principally intended expressly to be only for pedagogical purposes to aid the reader in understanding the principles of the proposed methods and devices and the concepts contributed by the inventors to furthering the art, and are to be construed as being without limitation to such specifically recited examples and conditions.

What is claimed is:

1. A fault-tolerant controller for a lighting system comprising a plurality of LED circuits and a controllable power source providing a drive voltage to power the plurality of LED circuits, the fault-tolerant controller comprising:

a control unit configured to cause regulation of the drive voltage based on a determination of a plurality of feedback voltages, one feedback voltage for each of the plurality of LED circuits; and a fault condition detecting means configured to identify one or more fault conditions from the plurality of feedback voltages, wherein at least one of the LED circuits is determined as a fault circuit having a fault condition for which the respective feedback voltage is below a first fault circuit condition threshold, wherein the fault condition detecting means is further configured, in response to a detected fault condition, to apply a test voltage to a cathode of the fault-circuit and, if the feedback voltage of the fault circuit remains below a second fault circuit condition threshold, the fault circuit is determined to have a short circuit condition, wherein the fault condition detecting means comprises a plurality of pull-up circuits, each pull-up circuit provided between ground voltage and a cathode for each LED circuit, wherein each pull-up circuit comprises a voltage source and a switch, the fault condition detecting means being configured to cause closing of the switch associated with the fault circuit upon detecting a fault condition to apply the test voltage to the cathode of the fault circuit.

2. The controller of claim 1 wherein the fault circuit is determined to have an open circuit condition if the feedback voltage of the fault circuit exceeds the second fault circuit condition threshold after the test voltage has been applied to the cathode of the fault circuit.

3. The controller of claim 2 wherein the controller further comprises a minimum voltage selector configured to exclude the one or more respective feedback voltages for each respective LED circuit associated with an open condition or a short circuit condition.

4. The controller of claim 1 wherein the controller further comprises a plurality of comparators and a plurality of logic gates, one comparator and one logic gate for each LED circuit to detect a fault condition indication for each of the LED circuits wherein a comparator is configured to conduct a comparison between the respective feedback voltage of one of the plurality of LED circuits and the first fault circuit condition threshold and to input the comparison result into the respective logic gate.

5. The controller of claim 1, wherein the fault condition detecting means is configured to determine whether a short circuit condition exists in the plurality of LED circuits during a pre-start test before normal operation of the LED lighting system is started, wherein no drive voltage is supplied to the plurality of LED circuits.

6. The controller of claim 5 wherein the controller is configured to disable the drive voltage to power the plurality of LED circuits if a short circuit condition is detected during the pre-start test.

7. The controller of claim 5 wherein in response to a pre-start test with no short circuit condition being detected, the controller is configured to wait for a predetermined time interval before regularly determining during an operation under a normal load condition whether a fault condition exists in one of the plurality of LED circuits.

8. The controller of claim 5 wherein a boost voltage to drive the LED circuit is temporarily disabled during a short circuit test.

9. The controller of claim 1 wherein the fault condition detecting means is configured to sample the feedback voltage of the fault circuit at least two times before determining a short circuit condition of the fault circuit.

10. A method of detecting a fault condition within a plurality of LED circuits of a lighting system comprising the steps of:

determining a feedback voltage for each of the LED circuits of the plurality of LED circuits;

causing regulation of a drive voltage to power the plurality of LED circuits based on the plurality of feedback voltages;

determining a fault circuit having a fault condition among the plurality of LED circuits for which the respective feedback voltage of the respective LED circuit is below a first fault condition threshold;

in response to the detected fault condition, applying a test voltage from a pull-up circuit comprising a voltage source and a switch to a cathode of the determined fault circuit having a fault condition; and if the feedback voltage of the determined fault circuit remains below a second fault circuit condition threshold, determining the fault circuit as having a short circuit condition, wherein applying the test voltage includes closing the switch associated with the fault circuit to apply the test voltage to the cathode of the fault circuit.

11. The method of claim 10 further comprising the step of determining the fault circuit as having an open circuit condition if the feedback voltage of the determined fault circuit exceeds the second fault circuit condition threshold after the test voltage has been applied to the cathode of the fault circuit.

12. The method of claim 10 wherein the method of detecting a fault condition is conducted as part of a pre-start test of the lighting system, before the normal operation of the LED lighting system is started, wherein no drive voltage is supplied to the plurality of LED circuits during the pre-start test and disabling the lighting system in response to a detected short circuit condition during the pre-start test.

13. A lighting system comprising:

a plurality of LED circuits;

a controllable power source; and a fault-tolerant controller for a lighting system comprising a plurality of LED circuits and a controllable power source providing a drive voltage to power the plurality of LED circuits wherein the controller is configured to detecting LED short circuits and/or LED open circuits, the controller comprising:

a fault condition detecting means configured to identify one or more fault conditions from the plurality of feedback voltages, wherein at least one of the LED circuits is determined as a fault circuit having a fault condition for which the respective feedback voltage is below a first fault circuit condition threshold, wherein the fault condition detecting means is further configured, in response to a detected fault condition, to apply a test voltage to a cathode of the fault circuit and, if the feedback voltage of the fault circuit remains below a second fault circuit condition threshold, the fault circuit is determined to have a short circuit condition, wherein the fault condition detecting means comprises a plurality of pull-up circuits, each pull-up circuit provided between ground voltage and a cathode for each LED circuit, wherein each pull-up circuit comprises a voltage source and a switch, the fault condition detecting means being configured to cause closing of the switch associated with the fault circuit upon detecting a fault condition to apply the test voltage to the cathode of the fault circuit.

* * * * *